United States Patent [19]

Penner

[11] 4,344,339

[45] Aug. 17, 1982

[54] ADJUSTABLE WRENCH

[76] Inventor: John Penner, P.O. Box 1348, Avondale, Ariz. 85323

[21] Appl. No.: 194,081

[22] Filed: Oct. 6, 1980

[51] Int. Cl.[3] ..... B25B 13/16

[52] U.S. Cl. ..... 81/157; 81/186

[58] Field of Search ..... 81/155, 157, 165, 170, 81/186

[56] References Cited

U.S. PATENT DOCUMENTS 1,155,937 10/1915 Lerfald ..... 81/165

1,490,062 4/1924 Nishimura ..... 81/157

2,849,908 9/1958 Swanstrom et al. ..... 81/165

4,048,876 9/1977 Cagle ..... 81/170 X

*Primary Examiner*—James G. Smith

*Attorney, Agent, or Firm*—Warren F. B. Lindsley

[57] ABSTRACT

A modified crescent wrench in which the adjustment and holding mechanism may be quickly engaged or disengaged. The spiral adjustment cylinder is mounted over an eccentric mandrel which is rotated about its own axis to engage or disengage the spiral cylinder with the moveable jaw of the wrench.

6 Claims, 11 Drawing Figures

ADJUSTABLE WRENCH

BACKGROUND OF THE INVENTION

A skilled mechanic's time is very valuable, and for this reason, it is quite important to reduce to a minimum that portion of his working time that is typically involved in work elements that are largely routine or highly repetitive in nature.

One operation that a mechanic performs many times during the course of the day, and an operation that does not utilize his special knowledge or skills, is the repeated adjustment and readjustment of a crescent wrench to fit nuts and bolts of various dimensions. This is especially true where the successive nuts or bolts encountered vary in dimension from very large to very small. A brief experience in this kind of work environment makes it quite apparent that an appreciable part of the working time is devoted to the adjustment and readjustment of the wrench.

DESCRIPTION OF THE PRIOR ART

Various types of adjustable wrenches have been devised in the past that incorporated quick adjustment features, but for various reasons they have not caught on. In some cases, the reason may have been the excessive cost; in others, the effectiveness of the quick adjustment feature was marginal. Quite obviously, the acceptance of such a tool by a skilled mechanic is very much dependent upon the smooth and reliable performance of the mechanism. It is, therefore, important that a simple but effective adjustment mechanism be provided that is not dependent for its operation on the precise interrelations between large numbers of intricatly formed parts.

The present invention is directed toward the provision of a very simply constructed adjustment mechanism that affords exceptionally quick and effortless operation.

SUMMARY OF THE INVENTION

It is, therefore, one object of the present invention to provide an improved adjustable wrench incorporating a quick adjustment mechanism.

Another object of the invention is to provide the adjustment mechanism in an unusually simple form that is at the same time smooth, effective and reliable in its operation.

A further object of this invention is to achieve the simplicity of the mechanism through the utilization of a very limited number of multi-functional parts.

A still further object of the invention is to provide an adjustment mechanism that is not subject to drift or self-adjustment after the desired adjustment has been made.

A still further object of the invention is to provide an adjustment mechanism that is sufficiently free of slack or play in the working of the jaws.

A still further object of the invention is to provide a positive locking action in connection with the quick adjustment feature.

A still further object of the invention is to provide in the adjustment mechanism a capability to fully disengage the movable jaw of the wrench so that the jaw may be removed, reversed and reinstalled for use as a pipe wrench.

Other objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings, in which.

DESCRIPTION OF THE PREFERRED EMBODIMENT

Figure 1:
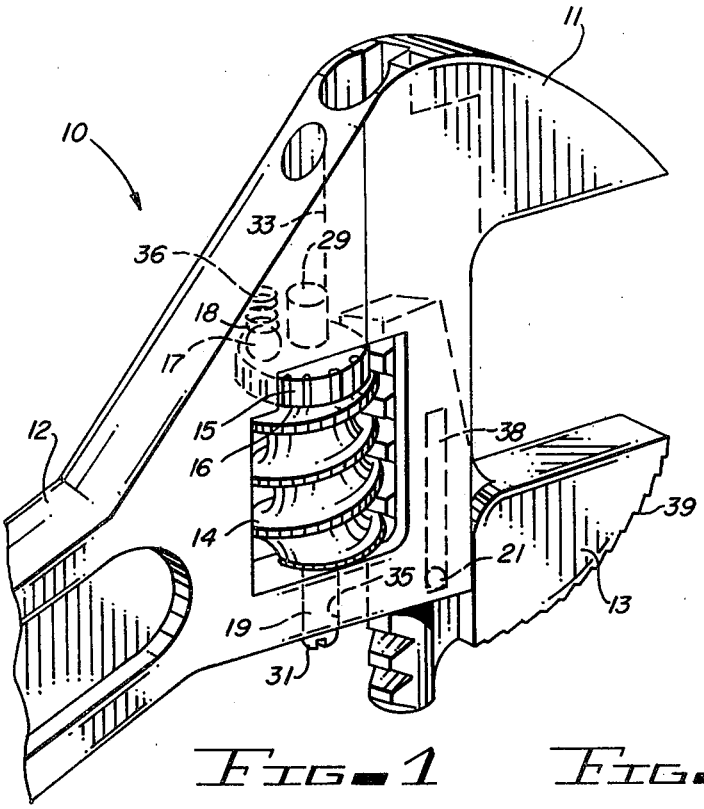
FIG. 1 is a perspective drawing of the adjustable wrench of the invention.

Referring more particularly to the drawing by characters of reference, FIGS. 1–9 disclose an improved adjustable wrench 10 comprising a fixed jaw 11 integral with a handle 12, a movable jaw 13, a spiral adjustment cylinder 14, an eccentric mandrel 15, a spring washer 16, a locking ball 17, a compression spring 18 and an axle or mounting pin 19. An additional spring loaded retaining ball 21 is hidden from view but shown by broken lines in FIGS. 1, 7 and 9.

The jaws 11 and 13 and the adjustment cylinder 14 are very similar to the corresponding parts of the commonly available adjustable wrench known as a crescent wrench. In the ordinary crescent wrench, the adjustment cylinder is mounted on an axle that passes through the central axis of the adjustment cylinder and is always engaged with the toothed edge of the movable jaw.

Figure 2:
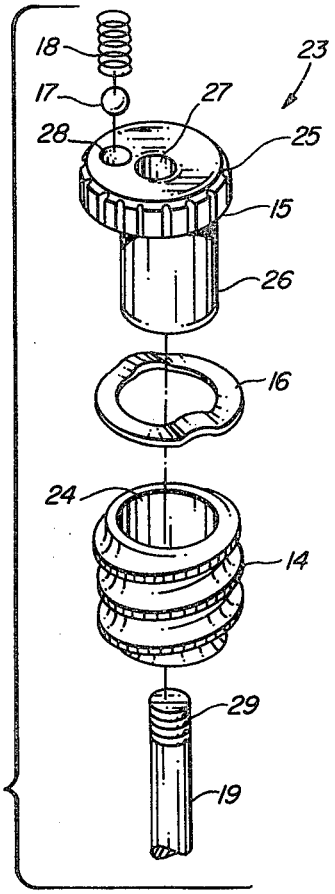
FIG. 2 is an exploded view of several of the working parts incorporated in the adjustment mechanism of the wrench of FIG. 1.
Figure 3:
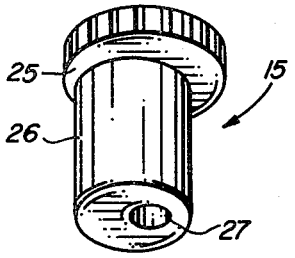
FIG. 3 is a perspective view from a different vantage point of one of the parts shown in FIG. 2.
Figure 4:
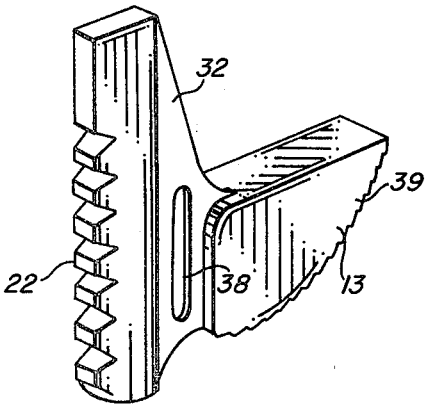
FIG. 4 is a perspective view of the removable and reversible jaw employed in the adjustable wrench of FIG. 1.
Figure 8A:
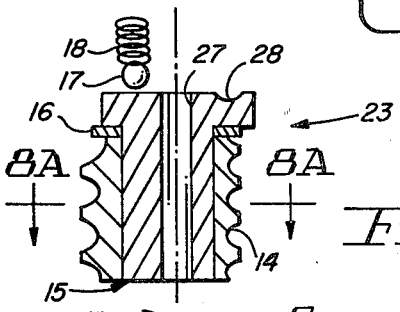
FIGS. 8A and 8B show two cross-sectional views of the adjustment mechanism corresponding to different conditions of use as viewed along lines 8A and 8B, respectively, of FIGS. 5A and 5B.
Figure 8B:
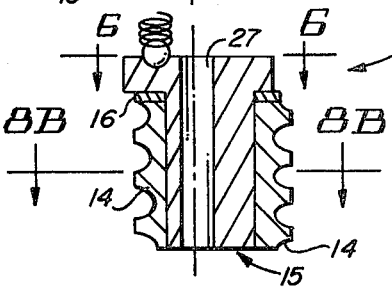
Figure 6:
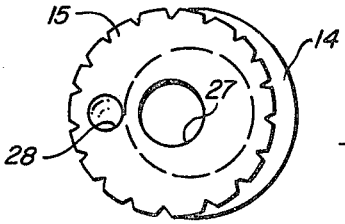
FIG. 6 is a top view of the assembly of FIG. 5 as viewed along line 6—6 of FIG. 5.
Figure 7:
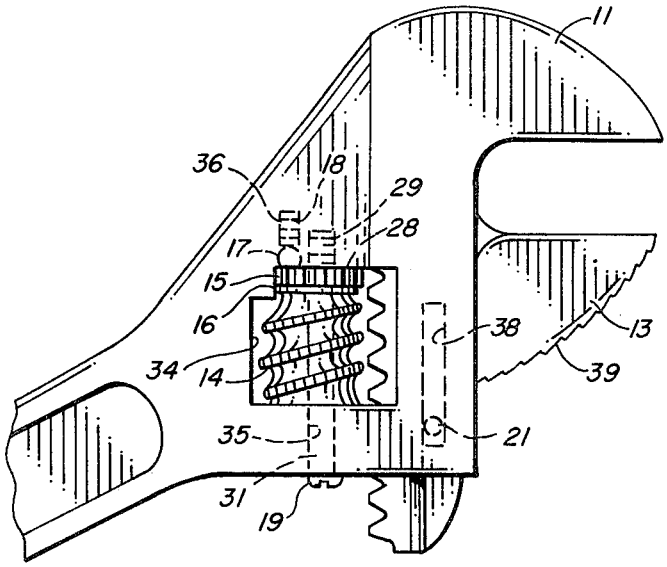
FIG. 7 is a side view of the adjustable wrench of the invention with the adjustment mechanism disengaged.

As shown most clearly in FIGS. 2, 3, 6 and 8, a modified form of mounting for the adjustment cylinder 14 permits the cylinder to be moved in and out of engagement with the toothed edge 22 of jaw 13. The mounting means and the cylinder 14 collectively referenced as an adjustment assembly 23, as shown in FIG. 2, comprises the spiral adjustment cylinder 14, the eccentric mandrel 15, the spring washer 16, the locking ball 17, the compression spring 18 and the axle 19.

The spiral adjustment cylinder 14 is identical with the corresponding part of the common crescent wrench except that its centered axial opening 24 is enlarged to receive the cylindrical body of the mandrel 15.

The mandrel 15 has a circular, wafer-shaped adjustment collar or head 25, the edge of which is grooved or knurled to facilitate its being gripped and rotated by the fingers of the mechanic. Extending perpendicularly from a non-centered point on the flat circular underside of the head 25 and integral therewith is the cylindrical body 26. A longitudinal mounting hole 27 passes through the radial center of the head 25 and longitudinally through the cylindrical body 26 offset from its longitudinal axis. Hole 27 is thus coaxial with respect to head 25 but eccentric with respect to the cylindrical body 26. The diameter of the cylindrical body 26 is appropriately sized so that it fits snugly but turns freely inside opening 24 of cylinder 14.

A small depression 28 on the top surface of head 25 near its circumference has a cylindrical contour that matches the surface of ball 17. Ball 17 is an ordinary ball bearing with spring 18 comprising a small coiled compression spring with a diameter approximately equal to that of ball 17.

The axle or mounting pin 19 is a circular rod threaded at one end 29 and slotted at the other end 31 to permit its installation by means of a screw driver.

The spring washer 16 has an inside diameter just great enough to permit its mounting over body 26 of mandrel 15. Washer 16 is bent slightly across its center so that when it is compressed between two plane surfaces it exerts a force against each of the two surfaces which tends to drive them apart.

Jaw 11 is slotted and grooved internally to receive the toothed fin 32 of movable jaw 13. Just rearward of the vertical internal slot 33 that receives fin 32 is a rectangular window 34 in which the assembly 23 is mounted. A vertical bore 35 in jaw 11 passes upward through the center of window 34. The upper end of bore 35 is threaded to receive the threaded end of axle 19; the lower end of bore 35 is dimensioned to receive the body of axle 19 with a slight clearance.

Assembly 23 is installed in window 34 utilizing the following procedure: Washer 16 is first mounted on body 26 of mandrel 15. Cylinder 14 is then mounted over the cylindrical body 26. The assembled mandrel 15, washer 16 and cylinder 14 are then positioned in window 34. As shown in FIG. 1, axle 19 is inserted from below through bore 35, threaded end first. The installation is completed by turning axle 19 with a screw driver to cause its threaded end to engage the threaded end of bore 35.

The foregoing installation procedure omitted for the sake of clarity the installation of ball 17 and spring 18. Just above the top surface of head 25 of mandrel 15, as installed in window 34 and on the far side of jaw 13, a small vertical bore 36 is provided to extend upwardly into jaw 11. Prior to the installation of assembly 23, spring 18 is installed in bore 36. Ball 17 is then pressed against the protruding end of spring 18, compressing spring 18 and driving ball 17 into bore 36. Ball 17 is held in place with the end of a screw driver or with the blade of a knife as assembly 23 is positioned in window 34, after which ball 17 and spring 18 are held in place by the top surface of head 25 of mandrel 15.

It will be noted that following the installation of assembly 23, mandrel 15 is rotatable about axle 19 and cylinder 14 is rotatable about the cylindrical body 24 of mandrel 15. The functions achieved by these two rotational actions are best described with reference to FIGS. 1, 5, 6 and 8.

Figure 5A:
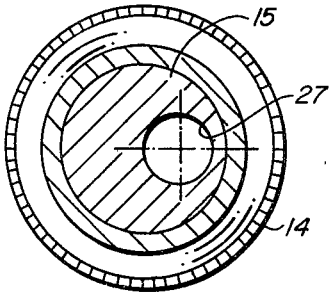
FIGS. 5A and 5B show two cross-sectional views of the parts of FIG. 2 assembled and in two different conditions of use.
Figure 5B:
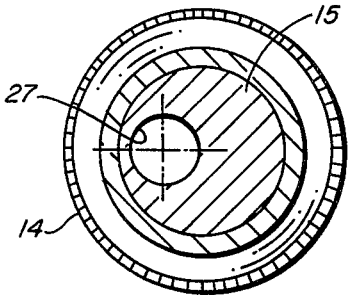

FIGS. 5A, 5B and 8A and 8B show corresponding views of assembly 23. In views 5B and 8B, the eccentric mandrel 15 has been rotated 180 degrees about its rotational axis 37 relative to its position in views 5A and 8A. Because of the eccentricity of the cylindrical body 26 relative to axis 37, the geometric center of the cylindrical surface of body 26 and cylinder 14 are moved to the left or to the right as mandrel 15 is rotated. The maximum displacement to the left is shown in views 5A and 5B and the maximum displacement to the right is shown in views 5B and 8B. As shown in FIGS. 5A and 5B, the depression 26 in the top surface of head 25 of mandrel 15 is approximately positioned so that it lies directly under bore 36 when mandrel 15 is rotated to the position shown in FIG. 5B, i.e., when cylinder 14 is displaced, the maximum amount to the right. This position of the mandrel 15 is nominally secured through the action of spring 18 as it drives ball 17 into depression 28. It is also in this position of mandrel 15 that spiraled cylinder 14 engages the toothed edge 22 of jaw 13.

It is thus seen that the locking action just described secures the engaged condition of assembly 23 with jaw 13.

Two additional functions are served by the spring-driven ball 17. The longitudinal thrust exerted by spring 18 prevents undesirable slack or play in the adjustment assembly 23 and it acts as a drag or inhibitor against self-adjustment of cylinder 14. Another design feature that discourages self-adjustment involves the relative dimensions of the adjustment cylinder 14 and mandrel 15. The length of cylinder 14 is slightly greater than the length of the cylindrical body 26 of mandrel 15. This dimensional relationship, together with the action of spring 16 accounts for additional drag between the adjustment assembly 23 and the surfaces of window 34 to further discourage drift or self-adjusting.

A longitudinal depression 38 is provided on each side of jaw 13, the depression 38 being aligned with the direction of movement of jaw 13 inside the internal slot 33 of jaw 11. The spring loaded ball 21 mounted in the adjacent surface of jaw 11 rides in depression 38 and prevents jaw 13 from falling out of slot 33 when the adjustment assembly 23 is disengaged.

It is possible, of course, to override the locking action of ball 17 to unlock the adjustment assembly 23 and it is possible to override the locking action of ball 21 to remove jaw 13 from the wrench structure.

Figure 9:
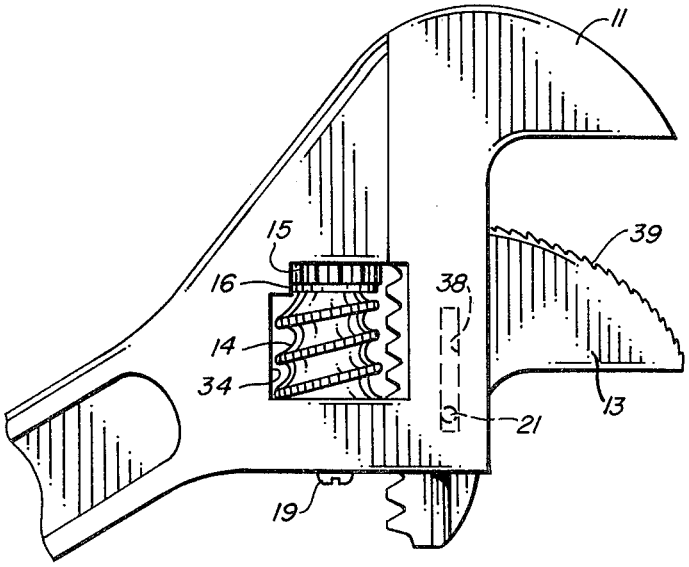
FIG. 9 is a side view of the adjustable wrench with the movable jaw reversed for use as a pipe wrench.

The removal of jaw 13 by overriding ball 21 is intentionally facilitated so that jaw 13 may be removed, reversed and reinstalled, as shown in FIG. 9, for use of the wrench 10 as a pipe wrench. The same quick adjustment features described earlier are, of course, also operative with this arrangement of jaw 13. Edge 39 of jaw 13 is grooved to enhance the use of jaw 13 in the reverse position, as just described.

An improved adjustable wrench is thus provided in accordance with the stated objects of the invention.

Although but a single embodiment of the invention has been illustrated and described, it will be apparent to those skilled in the art that various changes and modifications may be made therein without departing from the spirit of the invention or from the scope of the appended claims.

What is claimed is:

1. An adjustable wrench comprising:

a handle, a pair of cooperating jaws mounted on said handle, one of said jaws being fixedly attached to said handle, the other of said jaws being movably mounted on said handle for cooperating with said one of said jaws and having a toothed edge, a first opening provided in said handle juxtapositioned to said jaws, a cylinder having a spiral thread arranged along its outer periphery, a second opening provided in said cylinder and extending longitudinally therethrough, a mandrel, said mandrel comprising a cylindrical portion for fitting into said second opening and a collar at one end thereof positioned off center from the longitudinal axis of said cylindrical portion and extending outside of said second opening, a third opening extending through said collar and axially aligned with said second opening, means for mounting said cylinder with said mandrel positioned therein in said first opening with said cylindrical portion being rotatively attached axially along said second opening to said handle at one end and said collar at its other end being rotatively attached axially along said third opening to said handle, said collar when rotated causing said spiral thread to selectively engage or disengage with said tooth edge on said other of said jaws.

2. The adjustable wrench set forth in claim 1 wherein:

said other of its jaws is slidably mounted on said handle.

3. The adjustable wrench set forth in claim 1 wherein:

said other of said jaws is selectively mounted on said handle so that one of two faces cooperates with said one of said jaws.

4. The adjustable wrench set forth in claim 3 wherein:

said other of said jaws, when mounted on said handle in a given arrangement, causes said one of said surfaces to lie substantially parallel to a cooperating surface on said one of said jaws, and when said other of said jaws is mounted on said handle in another arrangement, it causes said other of said surfaces to extend in an arcuate configuration away from the cooperating surface on said one of said jaws.

5. The adjustable wrench set forth in claim 4 wherein:

said other of said surfaces on said other of said jaws is ridged.

6. The adjustable wrench set forth in claim 1 in further combination with:

a locking means for detachably holding said mandrel and said cylinder in engaged or disengaged position with the tooth edge of said other of said jaws.

* * * * *